United States Patent [19]

Greenfield

[11] Patent Number: 4,571,952

[45] Date of Patent: Feb. 25, 1986

[54] SOLAR AND CONVECTION ASSISTED HEAT PUMP SYSTEM

[75] Inventor: John B. Greenfield, Fort Smith, Ark.

[73] Assignee: Rheem Manufacturing Company, Fort Smith, Ark.

[21] Appl. No.: 542,898

[22] Filed: Oct. 18, 1983

Related U.S. Application Data

[63] Continuation of Ser. No. 250,083, Jun. 1, 1981, abandoned.

[51] Int. Cl.[4] ..... F25B 27/00

[52] U.S. Cl. ..... 62/235.1; 62/238.6; 62/324.1

[58] Field of Search ..... 237/2 B; 62/238.6, 235.1, 62/324.1, 324.4, 324.2; 126/417, 428

[56] References Cited

U.S. PATENT DOCUMENTS 4,392,359 7/1983 Franklin ..... 62/235.1

*Primary Examiner*—Henry Bennett

*Attorney, Agent, or Firm*—Allegretti, Newitt, Witcoff & McAndrews, Ltd.

[57] ABSTRACT

A solar and convection assisted heat pump for a building includes an oversized outdoor coil having a surface area at least thirty times greater than the surface area of the indoor coil. Additionally, the outdoor coil is mounted to maximize simultaneous exposure to the sun, exposure to the prevailing wind flow, and natural convective air flow over the panel heat exchanger.

3 Claims, 7 Drawing Figures

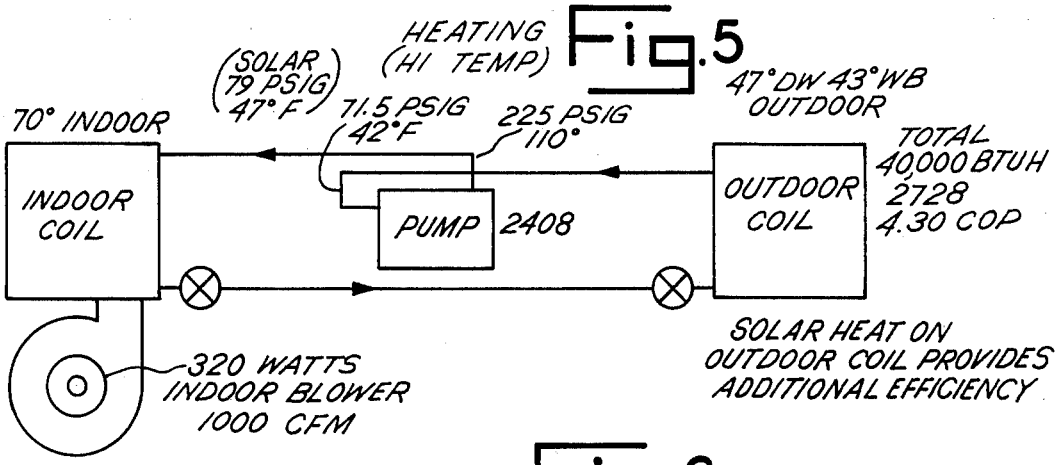
Fig. 5
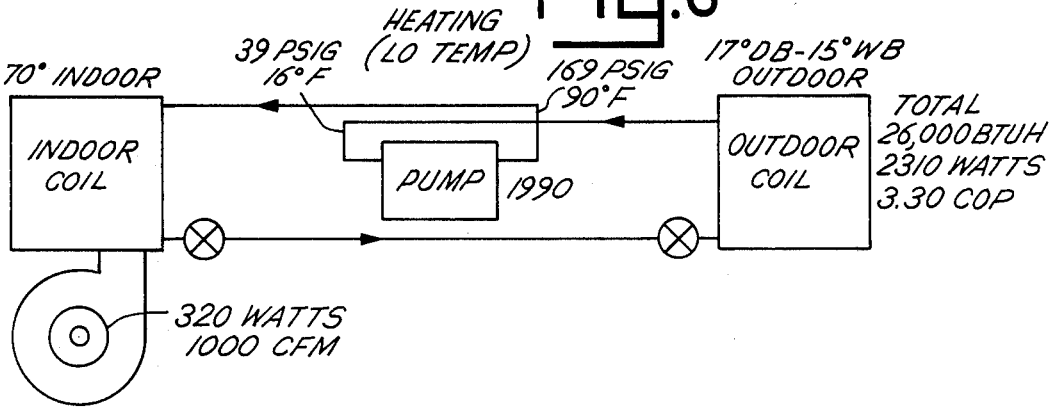
Fig. 6
Fig. 7
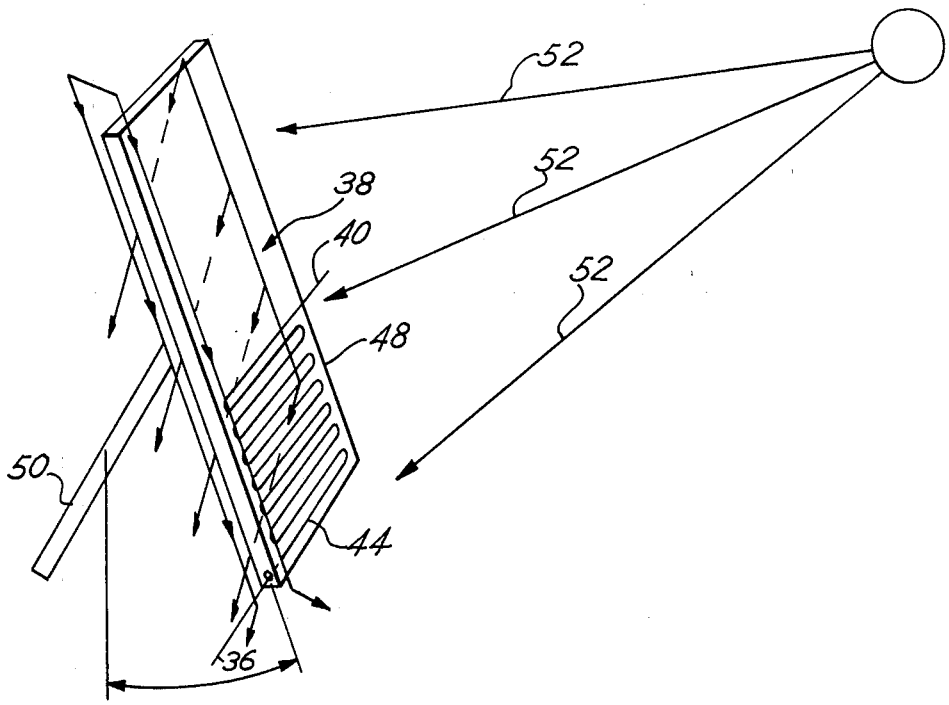

SOLAR AND CONVECTION ASSISTED HEAT PUMP SYSTEM

This application is a continuation of application Ser. No. 250,083, filed June 1, 1981, now abandoned.

BACKGROUND OF THE INVENTION

This invention relates to an improved solar and convection assisted heat pump system.

Use of a heat pump for indoor heating and cooling is well known. Heat pump systems are especially useful in the temperate sections of the United States to transfer heat between the outdoors and indoors.

There are many types of heat pump systems. A description of various heat pump systems is set forth in the 1976 ASHRAE Handbook and Product Directory published by the American Society of Heating, Refrigerating and Air Conditioning Engineers, Inc., particularly at pages 11.1 through 11.4. A bibliography in the ASHRAE Handbook also references various papers which describe heat pump systems.

One common type of heat pump system utilizes air as a heat source and sink and also uses air as the distribution fluid. The thermal cycle or transfer of heat between the outdoor and indoor air is accomplished by means of a refrigerant which is made to flow between an indoor coil and an outdoor coil in a refrigeration cycle.

A heat pump system, disclosed in the 1976 ASHRAE Guide and also discussed in a technical article by Sporn and Ambrose entitled "The Heat Pump and Solar Energy" (Association for Applied Solar Energy, Proceedings World Symposium on Applied Solar Energy, November 1955), teaches that the outdoor coil of a heat pump may be a solar panel. Various patents have also taught that a solar panel may be used as an outdoor coil in association with a heating or refrigeration system for a building. For example, Newton, in U.S. Pat. No. 2,342,211, teaches such a system. However, the Newton system does not contemplate a combined solar panel and heat pump system.

Other patents and publications of the same general type and nature include the following:

| Pat. No. | Inventor | Title | Issue Date |
|---|---|---|---|
| 2,342,211 | Newton | Utilization of Natural Heating and Cooling Effects | 2/22/44 |
| 2,396,338 | Newton | Radiation Heating and Cooling System | 3/12/46 |
| 2,689,090 | Wetherbee, et al | Heating System | 9/14/54 |
| 2,713,252 | Jackson, et al | Temperature Control System | 7/19/55 |
| 3,194,303 | Haried | Heat Pump System | 7/13/65 |
| 3,960,322 | Ruff, et al | Solar Heat Pump | 6/01/76 |
| 3,991,938 | Ramey | Combination Heat Pump and Low Temperature Solar Heat Absorber | 11/16/76 |
| 3,996,759 | Meckler | Environment Assisted Hydronic Heat Pump System | 12/14/76 |
| 4,007,776 | Alkasab | Heating and Cooling System Utilizing Solar Energy | 2/15/77 |
| 4,012,920 | Kirschbaum | Heating and Cooling System with heat Pump and Storage | 3/22/77 |
| 4,030,312 | Wallin et al | Heat Pumps with Solar Heat Source | 6/21/77 |
| 4,052,001 | Vogt | Heating System | 10/4/77 |

-continued

| Pat. No. | Inventor | Title | Issue Date |
|---|---|---|---|
| 4,066,118 | Goettl | Air Conditioning System | 1/03/78 |
| 4,103,493 | Schoenfelder | Solar Power System | 8/01/78 |
| 4,111,259 | Lebduska | Energy Conservation System | 9/05/78 |
| 4,167,965 | Rogers | Integral Water-Refrigerant-Air Heat Exchange System | 9/18/79 |
| 4,178,989 | Takeshita, et al | Solar Heating and Cooling System | 12/18/79 |

Article entitled "Solar Energy Supplemented Rural-Home Heat Pump" by George R. Mowry, Solar Energy, Vol. 8, No. 1, 1964, pages 12-16

Article entitled "Performance of a Solar Heated Office Building", by F. H. Bridgers, et al, Transactions American Society of Heating and Air-Conditioning Engineers, pages 83-110

There are additional patents and publications which teach the use of solar panels or solar absorption for heating and cooling building structures. Typical among these are the following:

| Pat. No. | Inventor | Title | Issue Date |
|---|---|---|---|
| 3,935,897 | Pulver | Method of Solar Heating and Cooling | 2/03/76 |
| 2,030,350 | Bremser | Solar Operated Refrigerating System | 2/11/36 |
| 2,221,971 | Haywood | Solar-Absorption Cooling System for Building Structures | 11/19/40 |
| 3,952,947 | Saunders | Heating and Ventilation System | 4/27/76 |

"The Hammer" - December 1979, page 3

While the referenced prior art teaches that solar collection coils may be used both for heating and cooling purposes in a building, none of the patents of known prior art appears to teach the combination of a solar assisted heat pump coil which relies simultaneously upon moisture evaporation or condensation on a coil, prevailing air flow in a geographical region over a coil, solar energy absorption by a coil, natural convection flow over a coil and the normal energy transfer mechanism associated with the cycles of a heat pump; namely, radiation transfer. The present invention constitutes what is believed to be an improved combination of all of these particular features and provides for significantly improved efficiency of heat pump operation, lower energy consumption and improved economies for a home heating and cooling system.

SUMMARY OF THE INVENTION

Briefly, the present invention comprises an improved solar and convection assisted reversible heat pump system for a building. The system includes an outdoor coil and an indoor coil. The surface area of the outdoor coil is significantly greater than that of the indoor coil and preferably at least thirty times greater. Additionally, the outdoor coil is especially mounted to accommodate and maximize various types of heat transfer. First the coil constitutes a black body and is oriented to maximize solar energy absorption during the heating season and to minimize absorption during the cooling season. Second, the outdoor coil is oriented to maximize natural convection flow, i.e., the flow due to temperature differential around the coil. Third, the outdoor coil is adapted to maximize the effect of moisture condensation or evaporation. Fourth, the outdoor coil is positioned to maximize heat transfer due to prevailing wind conditions.

Thus, it is an object of the present invention to provide an improved solar and convection assisted reversible heat pump system.

A further object of the present invention is to provide a heat pump system which has enhanced energy transfer characteristics.

Still a further object of the present invention is to provide a reversible heat pump system having an oversized outdoor coil.

One further object of the present invention is to provide a heat pump system having an outside coil which is mounted for cooperative heat transfer due to prevailing air flow conditions, natural convective air flow, and radiant heat exchange.

One further object of the present invention is to provide an improved reversible heat pump system which is easy to maintain, has a reasonable cost, and which is more fuel efficient than prior art systems.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 5 is a schematic diagram of the improved solar heat pump of the invention in the high temperature heating cycle;

FIGURE 6 is a schematic diagram of the improved solar assisted heat pump of the invention in the low temperature heating cycle; and FIG. 7 is a schematic diagram of the oversized outdoor coil associated with the improved solar assisted heat pump of the present invention as oriented with respect to prevailing air flow, sun direction and natural convection air flow.

DESCRIPTION OF THE PREFERRED EMBODIMENT

Figure 1:
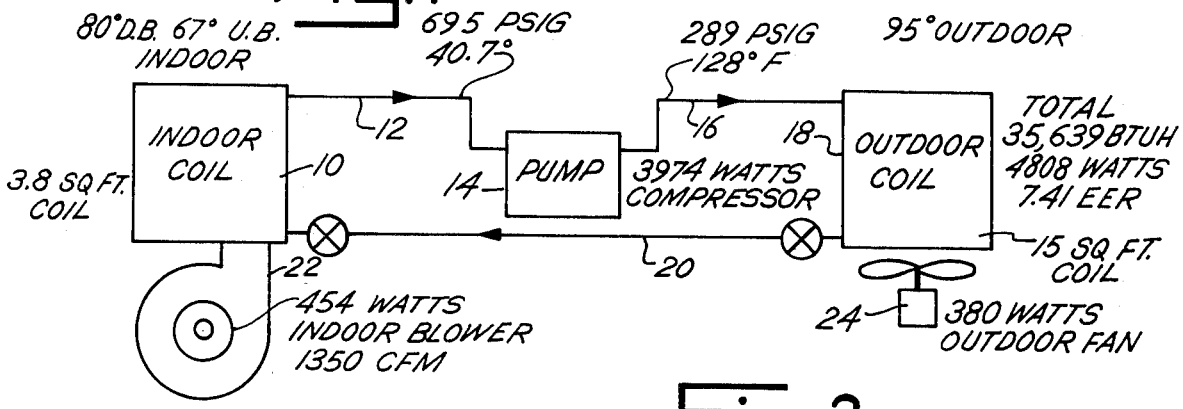
FIG. 1 is a schematic circuit diagram of a conventional heat pump in the cooling cycle.
Figure 2:
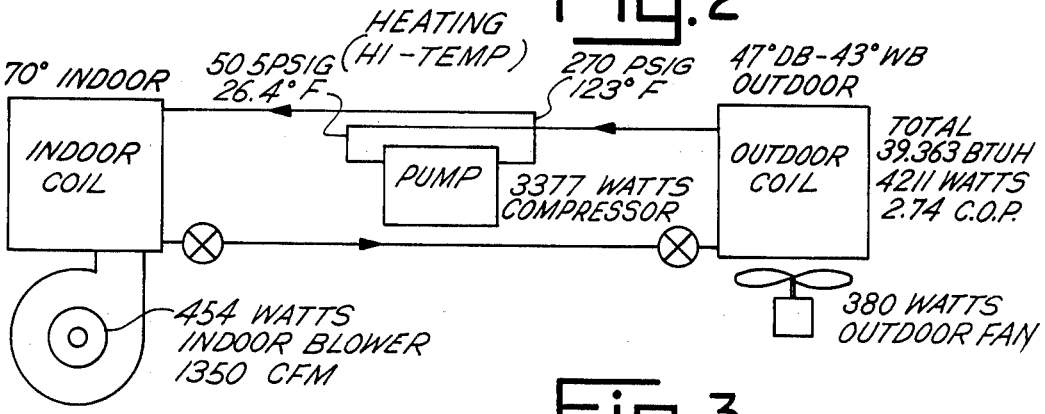
FIG. 2 is a schematic circuit diagram of a conventional heat pump in the high temperature heating cycle.
Figure 3:
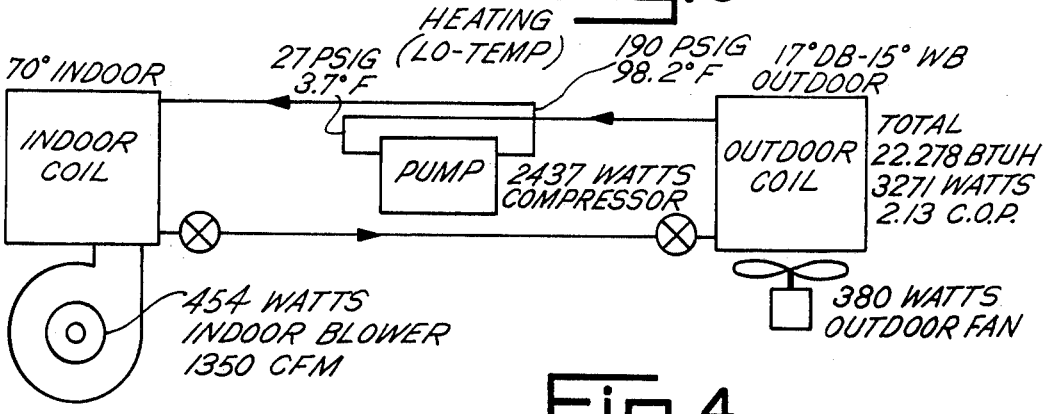
FIG. 3 is a schematic diagram of a conventional heat pump in the low temperature heating cycle.

FIGS. 1-3 represent schematically a conventional, three ton heat pump system which can provide for both cooling and heating for a building. An indoor coil 10 connects via line 12 with pump mechanism 14. The refrigerant material is cycled or pumped by the pump mechanism 14 through the system. Mechansim 14 includes a compressor, various valves and controls (not shown) known to those skilled in the art. The opposite side of the pump 14 is connected by a line 16 to an outdoor coil 18. A second line 20 interconnects the coils 10 and 18. An indoor fan 22 causes air to flow over the indoor coil 10 in order to effect heat transfer. Likewise a fan 24 associated with the outdoor coil 18 drives air over that coil 18 in order to effect appropriate heat transfer.

FIG. 1 represents the configuration of a conventional three ton capacity heat pump when in the cooling mode. The indoor coil 10 which typically will have a 3.8 square foot area receives relatively high pressure refrigerant which expands in the indoor coil 10 in the known manner to cause cooling by that coil 10. The refrigerant is subsequently transferred via line 12, pump 14 and line 16 to the outdoor coil 18 where the now pressurized refrigerant has energy removed. Typically the outdoor coil 18 will have an area of 15 square feet or approximately four times the surface area associated with the indoor coil. In the example shown in FIG. 1, the various settings associated with the energy transfer are set forth in the first left hand column in the following Table I:

TABLE I

| | Conventional Three Ton Heat Pump | | | Solar (Radiation) and Wind (Convection) Assisted Three Ton Heat Pump | | |
|---|---|---|---|---|---|---|
| | Cooling | Heating (High Temp.) | Heating (Low Temp.) | Cooling | Heating (High Temp.) | Heating (Low Temp.) |
| Indoor Ambient (°F.) | 80° D.B. 67° W.B. | 70° | 70° | 80° D.B. 67° W.B. | 70° | 70° |
| Outdoor Ambient (°F.) | 95° | 47° D.B. 43° W.B. | 17° D.B. 15° W.B. | 95° | 47° D.B. 43° W.B. | 17° D.B. 15° W.B. |
| Indoor Refrigerant Temp. (°F.) | 40.7 | 123 | 98.2 | 46 | 110° | 90° |
| Indoor Refrigerant Pressure (PSIG) | 69.5 | 270 | 190 | 78 | 225 | 169 |
| Outdoor Refrigerant Temp. (°F.) | 128 | 26.4 | 3.7 | 105 (100°)*** | 42 (47°)* | 16° F. (17°)* |
| Outdoor Refrigerant Pressure (PSIG) | 289 | 50.5 | 27 | 210 | 71.5 (79) | 39 |
| Compressor Power (watts) | 3974 | 3377 | 2437 | 2953 | 2408 | 1990 |
| Indoor Fan Pwr. (watts) | 454 | 454 | 454 | 320 | 320 | 320 |
| Outdoor Fan Pwr. (watts) | 380 | 380 | 380 | 0 | 0 | 0 |
| Cooling (Heating) Output (BTU/hr.) | 35,639 | 39,363 | 22,278 | 36,000 | 40.000 | 26,000 |
| Energy Required (watts) | 4808 | 4211 | 3271 | 3272 | 2728 | 2310 |
| Efficiency Rating (E.E.R. or C.O.P.) | 7.41 E.E.R. | 2.74 C.O.P. | 2.13 C.O.P. | 11.0 E.E.R. (12.0)*** | 420 C.O.P. (4.6)* | 3.30 C.O.P. (3.6)* |
| Indoor Coil Size (sq. ft.) | 3.80 | 3.80 | 3.80 | 7 | 7 | 7 |
| Outdoor Coil Size (sq. ft.) | 15 | 15 | 15 | 384 | 384 | 384 |

TABLE I-continued

| | Conventional Three Ton Heat Pump | | | Solar (Radiation) and Wind (Convection) Assisted Three Ton Heat Pump | | |
|---|---|---|---|---|---|---|
| | Cooling | Heating (High Temp.) | Heating (Low Temp.) | Cooling | Heating (High Temp.) | Heating (Low Temp.) |
| Outdoor Coil Orientation | Not applicable | Not applicable | Not applicable | 70°** | 70°** | 70°** |

*With full sunshine, the data in parenthesis is observed.
**The panel is aligned 70° from the horizontal and in a south/southwest heading.
***With 5 m.p.h. wind, the data in parenthesis is observed.

FIG. 2 illustrates the conversion of the standard heat pump system of FIG. 1 into a heating system where the outdoor temperature is considered to be somewhat moderate; namely 47° dry bulb temperature or 43° wet bulb temperature. The energy requirements and other significant data associated with this typical arrangement are set forth in the second left hand column of Table I as well as in FIG. 2. Note that the efficiency amount of heat transfer to the indoor coil is 4.2 to 4.6 COP with this arrangement.

FIG. 3 represents the situation when the outdoor temperature is significantly lower; namely 17° dry bulb, 15° wet bulb. In Table I, the relevant data is set forth with respect to the arrangement of FIG. 3 in the third left hand column.

Figure 4:
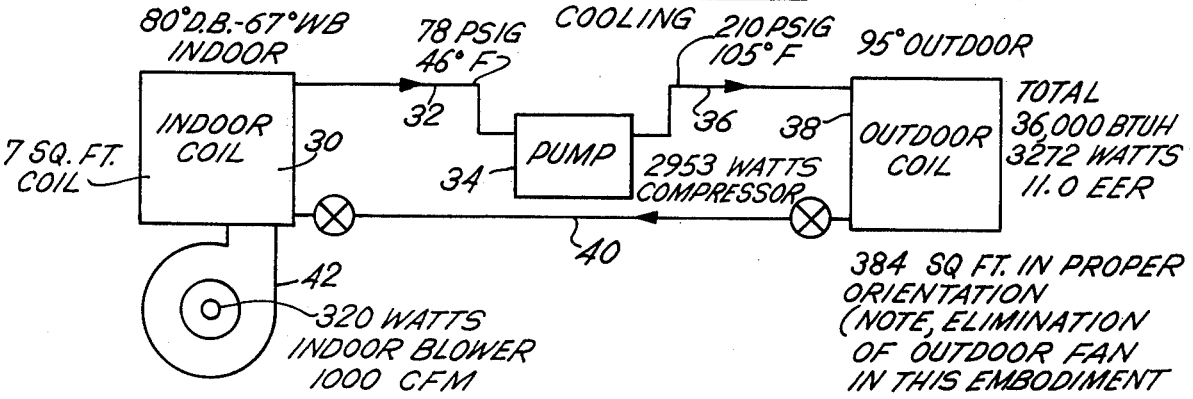
FIG. 4 is a schematic diagram of the improved solar assisted heat pump of the invention in the cooling cycle.

So far the description has related to a conventional, three ton heat pump configuration of the type known to those skilled in the art. FIGS. 4–7 and in particular FIGS. 4–6 represent in schematic diagrams the improved solar assisted heat pump of the present invention as arranged in a cooling, high temperature heating and low temperature heating configuration respectively.

Referring first to FIG. 4, an indoor coil 30 is maintained in substantially the same configuration as with the conventional system. The indoor coil 30 is connected through a line 32 with the pump 34. The pump 34 also connects by line 36 with outdoor coil 38. An interconnecting line 40 connects indoor coil 30 without outdoor coil 38. An indoor blower 42 blows air over the indoor coil 30. Note, however, that a fan or blower is not required for the outdoor coil 38.

Additionally, the outdoor coil 38 has a significantly increased surface area relative to the indoor coil 30. In practice, the surface area of the outdoor coil 38 is at least thirty times greater than that of the indoor coil 30 and preferably is in the range of fifty to sixty times greater than that of the indoor coil 30.

FIGS. 5 and 6 represent the configuration of the improved heat pump of the present invention in the high temperature and low temperature modes respectively which are analogous to the modes of the heat pump shown in FIGS. 2 and 3. The right hand columns of Table I also set forth the significant data with respect to a three ton heat pump configured in accordance with the schematic diagrams set forth in FIGS. 4, 5 and 6. For purposes of comparison, Table I also includes the energy outputs associated with typical three ton conventional heat pump as shown in FIGS. 1, 2 and 3 as well as the arrangement of FIGS. 4, 5 and 6. This comparative data illustrates the improvement in the efficiency of heating or cooling of the heat pump of the present invention.

As stated before, no fan is needed for the outdoor coil of the heat pump of FIGS. 4–6. Also, in testing the device shown in FIGS. 4–6 and particularly at the low temperature configuration of FIG. 6, it has been found that defrosting of the coils in extreme weather conditions is not necessary.

FIG. 7 illustrates an important feature of the present invention; namely, the orientation and arrangement of the outdoor coil 38. The outdoor coil 38 is formed from a wound tube 44 which has a plurality of fin members, preferably aluminum fin members affixed thereto. The tube 44 is retained on a bracket 48 and thus forms a large panel through which air may flow and upon which light may radiate. An inlet 36 and outlet from the coil 38 connects with the remainder of the heat pump system.

In operation, the bracket 48 is supported appropriately above ground level or above grade level by means of a support member, for example, support member 50 which is schematically illustrated. The orientation of the panel 38 is quite important to the practice of the invention. Thus, depending upon the geographical location of the panel 38 on the earth, the orientation is determined in accordance with a number of factors. First, the orientation must take into account the impingement of the rays of the sun represented by the lines 52. An object of the invention is to maximize the radiant energy transfer from the rays of the sun. To maximize radiant energy transfer, the panel should approach a horizontal position adjusted for latitude. Thus, if the panel 38 is located in the Midwest portion of the United States, the panel 38 should be adjusted at a slight incline toward the South in order to accommodate the path of the sun. Such solar energy design data is published by Reynolds Metals Company, Product Development Division and teaches that at a latitude of about 45° north, the panel should be tilted in the range of 20° to 40° from the horizontal toward the south to maximize radiant energy transfer. However, significant energy transfer can be effected at angles up to 75° from the horizontal. In the winter heating season, at the same 75° angle radiant energy will be minimized during the summer cooling season when heat is being rejected from the panel.

Second, the panel 38 must be oriented in order to intercept the prevailing wind or air flow in the region involved. Again, in the Midwest this is generally a west to east air flow. Thus, to satisfy this requirement, it is desired to stand the panel 38 substantially vertical and transverse to the east/west direction.

Third, it is desirable to maximize the effect of natural convection flow in the immediate region of the panel 38. Typically, natural convection causes hot air to rise and flow through the fins 46 and tube 44. Thus, for natural convection flow, the most preferred orientation of panel 38 is in the horizontal plane. This will accentuate heat transfer due to natural convection in the immediate area of the panel 38.

Fourth, the effect of moisture evaporation and condensation must be accentuated. Mounting the panel toward the horizontal inclination is desired with respect to this consideration.

In an effort to maximize these four types of heat transfer in addition to the radiant transfer due to the placing of the panel 38 in the atmosphere, both sides of the panel are free and the panel is oriented, for example, in the Midwest in a south/southwest inclination of approximately 50°–70° with the horizontal. It is possible to calculate the maximum efficient exposure angle utilizing solar elevation tables and weather information. Alternatively, the panel 38 may be positioned by empirical or experimental means to maximize its effect. Preferably the fins and tube 44 are coated to act as a black body. In order to improve efficiency, the effect of the energy associated with the sun upon the desired operation of the panel 38 can be diminished by shading, for example, and convection and radiation heat transfer phenomena will become more predominant.

In review, the system of the invention comprises a heat pump in which the outdoor coil is a relatively low cost, thin tube or plate coil. This coil is incorporated as the air heat source or heat rejection (outdoor coil) of the heat pump and serves as an energy collector or rejector by virtue of various physical phenomena including radiation, convection and conduction. Conduction takes place to the extent that moisture collects or is dissipated from the coil thereby utilizing or acquiring the energy of condensation, evaporization or change of state of water. The outdoor air heat source or heat rejection coil thus uses natural convection as opposed to a forced convection outdoor coil. This means the coil face area is relatively large and can therefore serve also as a solar collector. It also acquires the capability of collecting or rejecting large amounts of moisture. Preferably the outdoor coil is coated with material designed to absorb solar energy. It is also located and oriented to maximize solar energy or radiation transfer particularly in the winter months to permit good natural convection, to take advantage of natural wind currents and for exposure to natural precipitation. The coil location may be on a roof or on ground level. It can be mounted to a vertical wall of a structure or it can even take the form of a fence.

When the heat pump is in the heating mode of operation, refrigerant is evaporated in the outdoor coil and heat is absorbed in the refrigerant. The coil temperature becomes less than that of the surrounding air and heat is removed from the air. As heat is removed from the air, its change in density will cause natural convective air flow through and over the coil. Natural wind currents may further help move the air through the coil and improve heat transfer. Precipitation in the form of moisture on the coil surface will also improve heat transfer. Since the coil temperature is below the ambient air temperature, solar energy, when available, is absorbed on the coils and transferred to the refrigerant efficiently. Note that a fan and fan motor is not required on the outdoor coil. This too is an energy savings. Further improved performance and efficiency is expected over and above forced convection outdoor coils because defrost cycles as required on such prior art coils is reduced or eliminated. Ice buildup on the outdoor coil is thus reduced because of the relatively large coil base area, wide tin spacings, small temperature difference between the coil and the air, and also solar heating. In the event of ice buildup, natural convection will still occur over the iced coil surface to maintain system performance. A separate system for solar or radiation collection is not needed as in various prior art systems.

The energy or heat collected is used directly for space heating or it may be used for heating hot water or placed in some type of storage facility for future use. In this manner the system may be used as an off peak system for collecting energy. Also, domestic hot water may be obtained from the heat pump when the heat pump is either in the space heating or space cooling modes of operation. This again is another manner in which to improve system performance.

When the heat pump is in the cooling mode, refrigerant is condensed in the outdoor coil and heat is given up by the refrigerant to the coil surface. The coil then becomes warmer than ambient air temperature. Heat is transferred to the air and the change in air density will promote natural convection air flow through and over the coil. Natural wind currents that occur will help move the air through the coil and improve heat transfer. During periods of precipitation, the coil performance and total system efficiency will be improved due to evaporation of moisture on the coil surface. Since the coil temperature is above collection temperature, the effect of solar energy is diminished. Heat rejection can be improved by a shade positioned over the coil. Performance will improve during the evening and night when heat is radiated more easily. Again, there is no forced convection with respect to the outdoor coil. Thus, energy savings is realized with respect to the elimination of an outdoor fan.

While in the foregoing a preferred embodiment of the invention has been set forth, the invention is limited only by the following claims and their equivalents.

What is claimed is:

1. In an improved solar and convection assisted heating and cooling reversible heat pump system for a building of the type including a coil outside of the building for energy transfer and a coil inside of the building for energy transfer, the improvement comprising:

an outside coil having an effective surface area oversized relative to the surface area of the inside coil in a ratio of at least 30 to 1, the outside coil comprising a black body the tube forming an outside panel through which air may flow and upon which light may radiate; and mounting means for maintaining the outside panel oriented (a) distant from other structure so that both sides of the panel are within, and somewhat transverse to, an unobstructed path of prevailing region air flow, (b) with both sides of the panel open to air flow through the panel, (c) with one side of the panel oriented for solar energy incidence, and (d) in position to maximize heat transfer due to the simultaneous effects of (1) prevailing region air flow through the panel, (2) natural convection air flow around and through the panel, (3) moisture evaporation and condensation, and (4) radiant energy incidence of the panel wherein the panel position is a combination of a direction transverse to the prevailing region air flow, a horizontal position for maximum natural convection and evaporation and condensation energy transfer, and a direction transverse to the incidence of solar energy.

2. The system of claim 1 wherein the surface area ratio is in the range of 50–60 to 1.

3. The system of claim 2 or 1 wherein the mounting means includes a mounting bracket surrounding the periphery of the outside coil to prevent obstruction of the path of prevailing region air flow through the outside coil.

* * * * *